US009950919B2

(12) United States Patent
Benetti

(10) Patent No.: US 9,950,919 B2
(45) Date of Patent: Apr. 24, 2018

(54) BITS FOR HORSES

(71) Applicant: ACAVALLO S.r.l., Lonato del Garda (IT)

(72) Inventor: Mauro Benetti, Brescia (IT)

(73) Assignee: ACAVALLO S.R.L., Lonato del Garda (Brescia) (IT)

( * ) Notice: Subject to any disclaimer, the term of this patent is extended or adjusted under 35 U.S.C. 154(b) by 0 days.

(21) Appl. No.: 14/169,167

(22) Filed: Jan. 31, 2014

(65) Prior Publication Data

US 2014/0215977 A1 Aug. 7, 2014

(30) Foreign Application Priority Data

Feb. 1, 2013 (IT) ..... BS2013A0009

(51) Int. Cl.
*B68B 1/06* (2006.01)

(52) U.S. Cl.
CPC ..... *B68B 1/06* (2013.01)

(58) Field of Classification Search
CPC .... B68B 1/04; B68B 1/06; B68B 5/00; B68B 5/06; B68B 7/00; B68B 99/00
USPC ..... 54/7–9, 1
See application file for complete search history.

(56) References Cited

U.S. PATENT DOCUMENTS 162,348 A * 4/1875 Buermann ..... B68B 1/06 54/8
190,969 A * 5/1877 Hutton ..... B68B 1/06 54/7
351,007 A 10/1886 Tickner
584,582 A * 6/1897 Fogg ..... B68B 1/06 54/8
634,769 A 10/1899 Sell
1,178,998 A * 4/1916 Falls ..... B68B 1/06 54/7
2,172,501 A * 9/1939 Dalziel ..... B68B 1/06 54/7
2,488,977 A 11/1949 Johnson
3,205,636 A * 9/1965 Laningham ..... B68B 1/06 54/8
5,597,867 A * 1/1997 Tsujimoto ..... C08K 5/54 523/435
5,756,563 A * 5/1998 Brandolese ..... C08J 3/005 523/351
6,324,821 B1 * 12/2001 Bauer ..... B68B 1/06 54/8
6,425,229 B2 * 7/2002 Sprenger ..... B68B 1/06 54/9
6,553,747 B1 * 4/2003 Texel ..... B68B 1/06 54/6.1

(Continued)

*Primary Examiner* — Lisa L Tsang
(74) *Attorney, Agent, or Firm* — Robert E. Alderson, Jr.

(57) ABSTRACT

Bits for horses are provided which include a central element, suitable for being inserted in a horse's mouth, a pair of lateral rings, each connected to a respective end of the central element for connection to the reins, and a pair of rosettes for protecting the horse's lip, each traversed by an axial hole to be fitted around the central element, next to the connection to the ring. The axial hole is made in an emerging portion axially facing at least the side opposite the lateral ring. The wall which delimits said axial hole may be sized to provide a stable connection due to the friction between the rosette and the central element.

4 Claims, 3 Drawing Sheets

(56) References Cited

U.S. PATENT DOCUMENTS

| | | | | |
|---|---|---|---|---|
| 7,350,341 | B1 * | 4/2008 | Newell | B68B 1/06 54/7 |
| 2011/0011040 | A1 * | 1/2011 | Matern | B68B 1/04 54/6.1 |

* cited by examiner

BITS FOR HORSES

CROSS REFERENCE TO RELATED APPLICATION

This application claims priority to and benefit of Italian Patent Application No. BS2013A000009 filed Feb. 1, 2013, the contents of which are incorporated by reference in their entirety.

FIELD OF THE INVENTION

The present invention relates to bits for horses.

BACKGROUND OF THE INVENTION

As is known, generally a bit for horses includes a central element, for example, made of metal, possibly jointed, suitable for being inserted in the mouth of a horse, and at least a pair of lateral rings, each attached to a relative end of the central element for connection to the reins.

In conventional equipment, each ring is free to slide in a hole made at the end of the central element.

To protect the horse's lip from contact with the ring, and above all to prevent the horse's lip from catching in the coupling point between the central element and the ring, for example in the hole for the ring, a protective rosette is fitted on each end of the central element. Such protective rosette is typically a rubber disc in which a circular aperture is made to insert the central element.

Since protective rosettes are usually supplied separately from the bit, and in order to adapt the same rosette to various types and sizes of central element and rings, the aperture made on the rosette has a larger diameter than that of the central element. This way the rosette can, upon application of considerable force, pass beyond the ring to be fitted on the central element and in addition can be applied to different bits.

Because of the significant difference in diameter between the aperture made in the rosette and the cross-section of the central element, the rosette moves along said central element and may leave the point of connection with the ring bare. Thus, the efficacy of current rosettes is quite limited.

SUMMARY OF THE INVENTION

One object of the present invention is to provide a bit for horses which is able to overcome the drawbacks mentioned above.

Characteristics and advantages of bits according to the present invention will be evident from the description below made by way of non-limiting examples with reference to the appended drawings.

DETAILED DESCRIPTION

Figure 1:
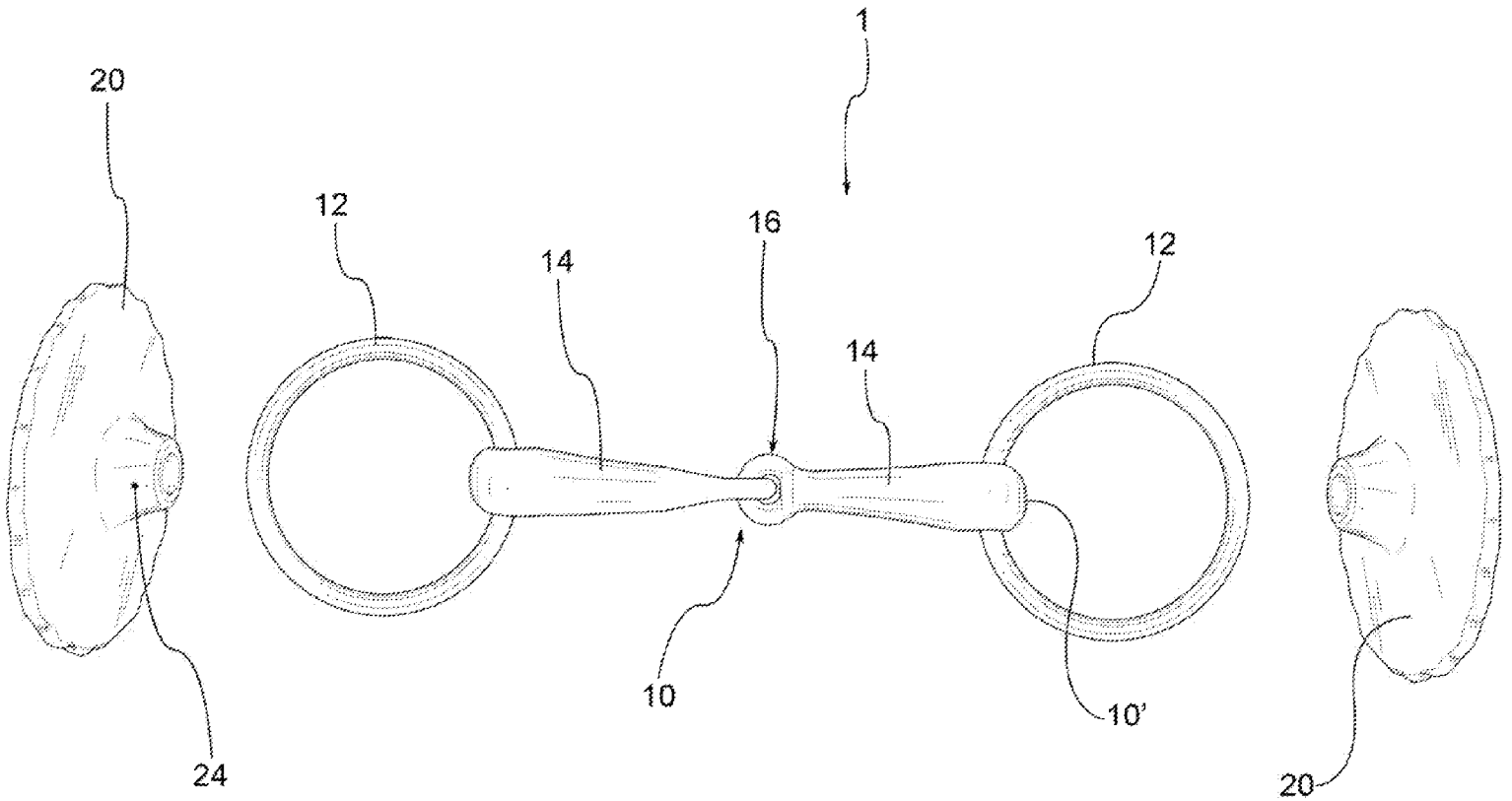
FIG. 1 shows a bit and a pair of protective rosettes, before the assembly thereof.
Figure 2:
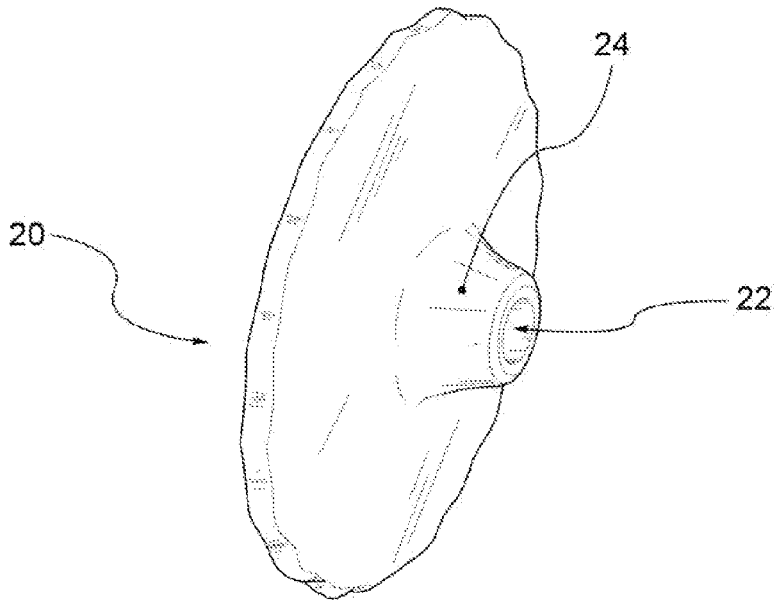
FIGS. 2 and 2*a* are two views of a protective rosette according to the present invention.
Figure 2A:
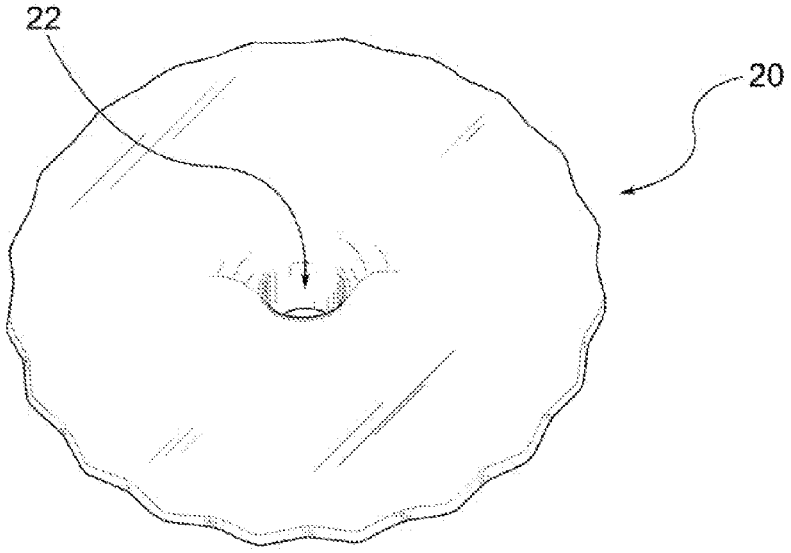

In said drawings, reference numerals 1 and 50 globally denote a bit for horses according to the present invention.

In a general embodiment, the bit for horses 1 and 50 includes a central element 10, 510, suitable for being inserted in the mouth of a horse, and a pair of lateral rings 12, 512, each connected to a respective end 10', 510' of the central element, for connection to the reins 80.

The bit 1, 50 is fitted with a pair of rosettes 20 for protecting the horse's lip. Each rosette 20 is traversed by an axial hole 22 to be fitted around the central element 10, 510, next to the connection to the lateral ring 12, 512.

According to one embodiment of the present invention, said axial hole 22 may be made in an emerging portion 24 of the rosette 20 axially facing towards the horse's lip, on the side opposite the ring 12, 512. The diameter of said axial hole 22 may be less than the diameter of the portion of the central element which the rosette is fitted onto which creates friction between the rosette 20 and the central element 10, 510.

This way, the rosette 20, once fitted onto the central element 10, 510 in the desired position, is no longer able to move, acts as a support element for the horse's lip and prevents contact with the lateral ring 12, 512.

The presence of the emerging portion 24 permits the rosette 20 to have at the axial hole 22, a thickness such as to be able to be elastically deformed to pass beyond the ring 12, 512 without breaking. In addition, such emerging portion 24 permits the rosette 20 to encompass an extensive portion of the central element 10, 510, ensuring a stable positioning of the rosette and a safe separation from the point of connection with the lateral ring 12, 512.

In certain embodiments, the protection rosette 20 may be made from thermoplastic gel. Such material assures considerable softness in contact with the horse's lip, a high level of friction on the central element 10, 510, favouring the blocking of the rosette, and the elasticity needed to widen the axial hole 22 to such a point as to render its diameter greater than that of the ring.

Thermoplastic gel used in a certain embodiments may be an elastomeric polymer, and more specifically may be composed for example, of copolymer styrene-hydrogenated butadiene blocks (30-80% p/p), paraffin oil (10-30% p/p) and other polymers 0-30% p/p).

In certain embodiments, the emerging portion 24 may be in the form of a truncated cone, tapering towards the horse's lip. The outer surface of said emerging portion 24 thus connects the rosette to the outer surface of the central element 10, 510 so as to increase the comfort of the horse when the lip comes into contact with the rosette 20.

The bit 1 shown in FIG. 1 has a central element 10 which includes two arms 14 connected centrally by a joint 16. The two arms 14 taper from the outer end towards the central joint 16. In this embodiment, the emerging portion 24 of a truncated cone shape of the rosette 20 adapts to the tapering of the arm.

The outer end 10' of each arm 14 may be traversed by a hole which a lateral ring 12 is inserted in.

Figure 3:
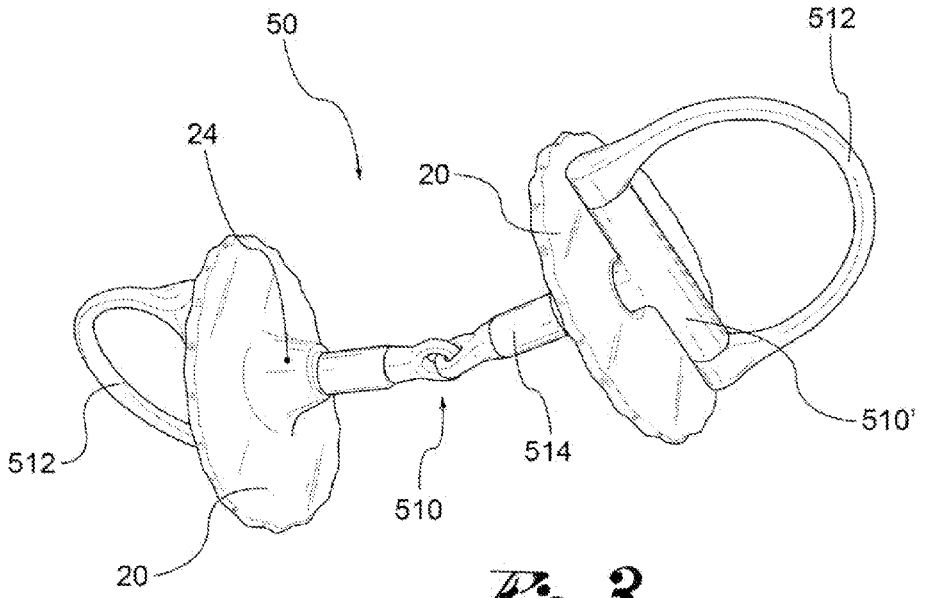
FIG. 3 shows a bit complete with rosette.
Figure 4:
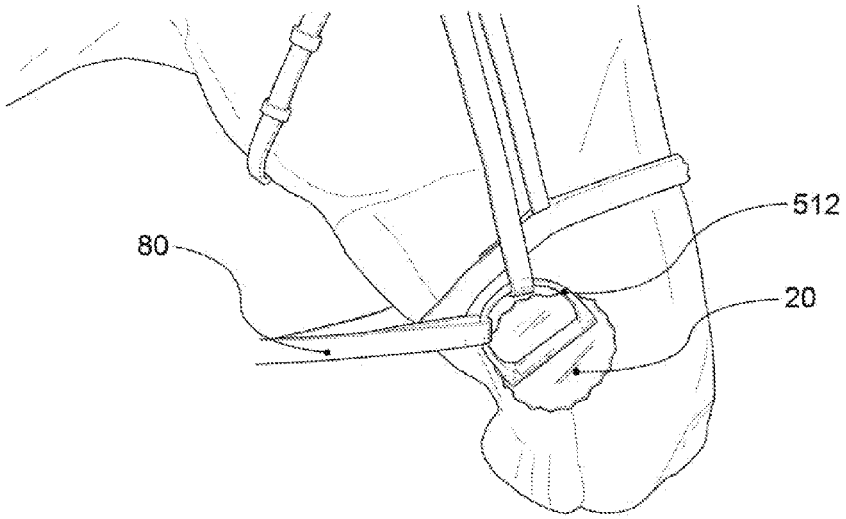
FIG. 4 shows the bit of FIG. 3 in use.

In one embodiment shown in FIG. 3, the central element 510 includes two T-shaped parts 514, connected to each other by a central joint 516. The vertical portion 510' of each part 514 (considering the bit directed horizontally), acts as a hinge for the lateral ring 512, which in this case is C-shaped.

A person skilled in the art, based on the teachings of the present disclosure, may make certain modifications and adaptations to embodiments of the bit, replacing certain elements with others functionally equivalent so as to satisfy contingent requirements while remaining within the scope of protection of the following claims. In addition, features described with certain embodiments may be combined with the features of other embodiments. Such combinations still remain within the scope of the present invention.

What is claimed is:

1. A bit for horses comprising a central element, suitable for being inserted in a horse's mouth, a pair of lateral rings, each connected to a respective end of the central element for connection to reins, and a pair of rosettes for protecting the horse's lip, wherein the central element comprises two arm portions connected centrally by a joint, each of the arm portions extending between the joint and one of the pair of lateral rings, each of the rosettes extending around a rosette axis and being traversed by an axial hole fitted around a respective terminal portion of one of the arm portions, next to a connection to the respective lateral ring, wherein said axial hole is formed in an emerging portion of each of the rosettes axially facing at least a side opposite the lateral ring, wherein a diameter of each axial hole is less than a diameter of the terminal portion of the arm portion which is to be fitted inside the axial hole when each of the rosettes is in a configuration at rest in which the axial hole is not fitted around the terminal portion of the arm portion, creating, when the axial hole is fitted around the terminal portion of the arm portion, a friction-implemented stable contact to prevent axial and angular displacement between each of the rosettes and its respective arm portion, wherein each of the rosettes is no longer able to move when the axial hole is fitted around the terminal portion of the arm portion, and wherein the rosettes comprise elastically deformable material which permits the axial hole to be widened to pass beyond the lateral ring.

2. The bit of claim 1, wherein the rosette comprises thermoplastic gel.

3. The bit of claim 2, wherein the rosette comprises an elastomeric polymer which comprises copolymer styrene-hydrogenated butadiene blocks (30-80 weight %), paraffin oil (10-30 weight %) and other polymers (0-30 weight %).

4. The bit of claim 1, wherein said emerging portion is in a truncated cone shape which tapers toward the horse's lip.

* * * * *